United States Patent [19]

Mori et al.

[11] Patent Number: 4,639,751

[45] Date of Patent: Jan. 27, 1987

[54] IMAGE-RECEIVING SHEET FOR HEAT TRANSFER RECORDING SYSTEM

[75] Inventors: Tohru Mori; Takayasu Hongo; Rinzo Kamikura, all of Amagasaki, Japan

[73] Assignee: Kanzaki Paper Mfg. Co., Ltd., Tokyo, Japan

[21] Appl. No.: 785,443

[22] Filed: Oct. 7, 1985

[30] Foreign Application Priority Data

Oct. 9, 1984 [JP] Japan ..... 59-211866

[51] Int. Cl.[4] ..... B41M 5/26

[52] U.S. Cl. ..... 346/227; 346/207; 346/214; 428/323; 428/328; 428/329; 428/330; 428/331; 428/409; 428/484; 428/488.1; 428/488.4

[58] Field of Search ..... 346/227, 207, 214; 428/207, 323, 328–331, 484, 488.1, 488.4, 913, 914, 195, 409

[56] References Cited

U.S. PATENT DOCUMENTS 4,744,859 10/1984 Oshima et al. ..... 428/207

FOREIGN PATENT DOCUMENTS 0137191 8/1982 Japan ..... 346/227

*Primary Examiner*—Bruce H. Hess

[57] ABSTRACT

An image-receiving sheet for a heat transfer recording system. The sheet comprises a substrate coated with an image-receiving layer comprised mainly of non-plate-shaped inorganic pigment and a binder. The smoothness of the image-receiving surface as determined according to TAPPI Standard T479 om-81 is 200 to 1,000 sec/10 ml, and the air permeability of the image-receiving sheet, as determined according to ASTM D726 Method B is below 500 sec/100 ml.

5 Claims, No Drawings

IMAGE-RECEIVING SHEET FOR HEAT TRANSFER RECORDING SYSTEM

FIELD OF THE INVENTION

The present invention relates to an image-receiving sheet for a heat transfer recording system. Particularly, the invention relates to an image-receiving sheet which ensures good image quality.

BACKGROUND OF THE INVENTION

Recently, attention has been paid to a heat transfer recording system in which an image-receiving sheet is laid on the inked surface of a sheet of paper or a plastic film coated on the surface with a heat-meltable dye (hereinafter referred to as "transferring sheet"), said transferring sheet being heated by means of a thermal head, thereby the ink layer of said transferring sheet being fluidized and transferred to said image-receiving sheet, then said two sheets being released one from the other, thus an image being obtained on said image-receiving sheet. For example, U.S. Pat. No. 3,983,279 discloses coating a base sheet with materials, such as a combination of a metallic salt of fatty acid and a phenol, which develop color by the reaction of two components, either or both of said materials being melted by means of a thermal head and transferred to an image-receiving sheet, thereby a color developed image being obtained. U.S. Pat. No. 4,474,859 discloses that the image-receiving layer of an image receiving sheet, which is used in combination with a transferring sheet coated on the surface with a heat sublimatable dye, comprises a resin such as saturated polyester resin and polyvinyl pyrrolidone, and if necessary, fillers such as calcium carbonate.

The image-receiving sheet used in the heat transfer recording system is required to accurately receive and fix the image ink fluidized by the thermal head. If the image-receiving sheet is an uncoated paper, the transferred image is liable to have white dropouts which deteriorate image quality, because the surface of such a paper is rough. Therefore, it is known that an image-receiving sheet coated with a coating composition consisting mainly of a pigment and an adhesive, the coated surface thereof being smoothed, can be used in place of the uncoated paper. Said image-receiving sheet coated with the coating composition has fewer white dropouts and better image quality than the uncoated paper. However, in said image-receiving coated sheet, the fixing ability of the transferred image tends to become worse. This causes image ink to be transferred reversely to the transferring sheet at the time of sheet release. As a result, the image density of the image-receiving coated sheet becomes low and partially irregular, and furthermore the transferred image is mottled.

OBJECTS AND SUMMARY OF THE INVENTION

It is an object of the invention to provide an image-receiving sheet on which the transferred image fixes well without white dropouts.

It is another object of the invention to provide an image-receiving sheet for a heat transfer recording system, which sheet has a high image density and is free from irregular density and mottling.

As a result of extensive study, the inventors have successfully developed the above-mentioned image-receiving sheet for a heat transfer recording system by using non-plate-shaped inorganic pigment as the main component of an image-receiving layer, adjusting the smoothness of the image-receiving surface thereof to 200 to 1,000 sec/10 ml and adjusting the air permeability of the image-receiving sheet to below 500 sec/100 ml.

Since non-coated paper is not smooth enough to serve as an image-receiving sheet, the image-receiving sheet, according to the present invention, comprises an image-receiving layer consisting mainly of inorganic pigment and binder, said image-receiving layer being laid on a substrate. Said inorganic pigment consists mainly of a non-plate-shaped pigment of below 10$\mu$, preferably below 5$\mu$ mean particle size and, if necessary includes other pigments. After coating, the image-receiving sheet is adapted so that the smoothness of its image-receiving surface is 200 to 1,000 sec/10 ml according to the test method of JIS P8119 (this corresponds to TAPPI Standard T 479 om-81, and will hereinafter be designated as "TAPPI Standard"), and so that the air permeability of the image-receiving sheet is below 500 sec/100 ml, preferably 30 to 500 sec/100 ml, according to the test method of JIS P8117 provided that oil is replaced by mercury; (this method corresponds to Method B of ASTM D726, and will hereinafter be designated as "ASTM").

The present invention relates to an image-receiving sheet for receiving images not only from a transferring sheet coated on its reverse side with a carbon ink consisting mainly of carbon black and a heat meltable wax, but also from a color (including black) transferring sheet. Therefore, the transferring sheets include a heat transfer recording sheet comprising a sheet of paper or a film coated with an ink consisting mainly of a colored pigment or dye and a heat meltable wax.

The smoothness of the image-receiving surface can be adjusted generally by changing the kind, particle size or shape of the pigment used and/or by the conditions of the smoothing treatment, etc. However, if the smoothness is increased by intensifying the smoothing treatment, the sheet (coating layer and substrate) becomes dense. Therefore, the passage of air is reduced and the values for the air permeability are increased. As a result, the fixing ability of the transferred image tends to be reduced. In order to satisfy both of the image quality and the fixing ability, the present invention specifies both the smoothness and the air permeability so that their values respectively fall within certain ranges. In a case where the pigment component of the image-receiving layer consists only of plate-shaped pigment such as kaolin and aluminum hydroxide, the value of the air permeability exceeds its specified range if the smoothness is to be maintained within its specified range. Therefore, in the present invention, it is essential that the pigment component of the image-receiving layer consists mainly of a non-plate-shaped material. The air permeability is influenced by the kind of binder, the amount of the binder used, the ratio of the binder to the pigment, etc. For example, a thermoplastic resin tends to increase the value of the air permeability as compared with natural binders such as starches and cellulose derivatives.

DETAILED DESCRIPTION

The image-receiving sheet of the present invention is laid on a transferring sheet of a heat transfer recording system, and the ink layer of the transferring sheet is fluidized by the contact of a thermal recording head driven by signals so that an image is transferred to the image-receiving sheet. The substrate supporting the image-receiving layer is generally made of paper. The non-plate-shaped inorganic pigment contained in the image-receiving layer means inorganic non-plate-shaped particles, and may be zeolite, precipitated calcium carbonate, natural ground calcium carbonate, silica, magnesium silicate, titanium dioxide, satin white, etc. which preferably have an oil absorption of above 30 ml/100 g in view of ink acceptance. Said non-plate-shaped inorganic pigment is coated on the substrate and smoothed either singly or along with other pigment such as kaolin and aluminum hydroxide. Said non-plate-shaped inorganic pigment and said other pigment are preferably in the ratio 60 to 100:40 to 0 parts by weight. In smoothing the image-receiving surface, it is important that the smoothness (as determined according to TAPPI Standard T 479 om-81) thereof is 200 to 1,000 sec/10 ml while the air permeability (ASTM D726 Method B) of the image-receiving sheet is maintained below 500 sec/100 ml. The desired image-receiving sheet can be obtained only when both of these two conditions are satisfied.

The air permeability of the image-receiving sheet is delimited to below 500 sec/100 ml, preferably 30 to 500 sec/100 ml because this is a condition necessary for ensuring that transferred image ink permeates the image- receiving sheet and fixes well. If the air permeability of the image-receiving sheet is above 500 sec/100 ml, the permeability of the transferred image ink is reduced and the fixing ability thereof is affected, and as a result the transferred image is rubbed off and stained. Higher permeability of air is desired from the viewpoint of the fixing ability of the transferred image, but actually the lower limit of the air permeability is about 30 sec/100 ml when the sheet is coated and adapted to have the aforesaid smoothness. The smoothness of the image-receiving surface is delimited to 200 to 1,000 sec/10 ml because of the following: If the smoothness is below 200 sec/10 ml, the surface is too rough and the transferred image is liable to have white dropouts. If the smoothness is above 1,000 sec/10 ml, the image density becomes irregular at the time of sheet release after image transfer and it is impossible to obtain good image quality.

Said non-plate-shaped inorganic pigment is contained in a coating composition to be coated on the substrate. The binder of the pigment may be one or a combination of the following: water soluble or dispersible adhesives such as modified starches, including oxidized starch, etherified starch, esterified starch and cationic starch, cellulose derivatives including methyl cellulose and hydroxyethyl cellulose, polyvinyl alcohols, and sodium salt and ammonium salt of styrene-maleic anhydride copolymer; and emulsion adhesives such as styrene-butadiene copolymer, vinyl acetate copolymer and vinyl chloride copolymer. The amount of these adhesives to be used has relation to the air permeability of the image-receiving sheet. On condition that the air permeability of the image-receiving sheet is maintained below 500 sec/100 ml, the amount of the adhesives is decided in connection with the kind of pigment used. The adhesives are used in the ratio of generally 5 to 60 parts by weight, preferably 10 to 40 parts by weight, to 100 parts by weight of pigment. If necessary, auxiliary agents such as a dispersing agent, water resisting agent, antiseptic agent and dye are added to the coating composition. The coating composition thus obtained is applied by means of a conventional coater, such as a size-press coater, gate roll coater, air knife coater, roll coater, blade coater and bar coater, onto one surface or both surfaces of a substrate so that the dry weight of coating applied is above 1 g/m$^2$, preferably 5 to 25 g/m$^2$, per surface. Then, the sheet is smoothed generally by means of one of the known smoothing apparatuses, such as a supercalender.

As compared with conventional image-receiving sheets, the image-receiving sheet of the present invention has many fewer white dropouts in transferred images, image density without partial irregularity, and reduced mottling.

The following are some examples of the present invention. It is to be noted that the scope of the invention is not limited to these examples.

"Parts" in the following examples and comparative examples means "parts by weight".

EXAMPLE 1

A coating composition having a solids content of 35% was prepared by mixing 85 parts natural ground calcium carbonate having a mean particle size of 2μ,15 parts kaolin, 5 parts oxidized starch and 10 parts (solid matter) styrenebutadiene copolymer latex. The coating composition was applied by means of an air knife coater to one surface of an uncoated paper, having a basis weight of 54 g/m$^2$, so that the coating weight, dry basis, was 10 g/m$^2$, and the paper was then dried.

The coated paper was supercalendered to obtain an image-receiving sheet having a smoothness under TAPPI Standard T 479 om-81 of 350 sec/10 ml and an air permeability under ASTM D726 Method B of 100 sec/100 ml. The image-receiving sheet was laid on an image-transferring sheet (a glassine paper of 25μ coated with black carbon ink) and heat transfer recording was performed by means of a printer (Model KTP-1010 made by Kanzaki Paper Mfg. Co. Ltd., Japan). An image transferred to the image-receiving sheet had good quality. The image was free from white dropouts, irregular density, mottling, etc. The fixing ability of the image was good.

EXAMPLE 2

A coating composition was prepared in the same way as in Example 1 except that the amount of said natural ground calcium carbonate having a mean particle size of 2μ was 65 parts and the amount of said kaolin was 35 parts. The coating composition was applied by means of an air knife coater to one surface of an uncoated paper having a basis weight of 54 g/m$^2$, so that the coating weight, dry basis, was 10 g/m$^2$; the paper was then dried.

The coated paper was supercalendered to obtain an image-receiving sheet having a smcothness under said TAPPI Standard of 950 sec/10 ml and an air permeability under said ASTM of 340 sec/100 ml. The image-receiving sheet was subjected to heat transfer recording in the same way as in Example 1. An image transferred to the image-receiving sheet had good quality. The image was free from white dropouts, irregular density, mottling, etc. The fixing ability of the image was good.

EXAMPLE 3

A coating composition having a solids content of 35% was prepared by mixing 100 parts natural ground calcium carbonate having a mean particle size of 2μ, 5 parts oxidized starch and 10 parts (solid matter) styrene-butadiene copolymer latex. The coating composition was applied by means of an air knife coater to one surface of an uncoated paper having a basis weight of 54 g/m$^2$, so that the coating weight, dry basis, was 10 g/m$^2$; the paper was then dried.

The coated paper was supercalendered to obtain an image-receiving sheet having a smoothness under said TAPPI Standard of 250 sec/10 ml and an air permeability under said ASTM of 100 sec/100 ml. The image-receiving sheet was subjected to heat transfer recording in the same way as in Example 1. An image transferred to the image-receiving sheet had good quality. The image was free from white dropouts, irregular density, mottling, etc. The fixing ability of the image was good.

EXAMPLE 4

A coated paper was prepared in the same way as in Example 2 except that said 65 parts natural ground calcium carbonate having a mean particle size of 2$\mu$ was replaced by 65 parts silica having a mean particle size of 2.5$\mu$. The coated paper was supercalendered to obtain an image-receiveing sheet having a smoothness under said TAPPI Standard of 380 sec/10 ml and an air permeability under said ASTM of 160 sec/100 ml. The image-receiving sheet was subjected to heat transfer recording in the same way as in Example 1. An image transferred to the image-receiving sheet had good quality. The image was free from white dropouts, irregular density and mottling. The fixing ability of the image was good.

EXAMPLE 5

A coating composition having a solids content of 35% was prepared by mixing 85 parts precipitated calcium carbonate having a mean particle size of 0.5$\mu$, 15 parts kaolin, 3 parts oxidized starch and 10 parts (solid matter) polyvinyl alcohol. The coating composition was applied by means of an air knife coater to one surface of an uncoated paper having a basis weight of 54 g/m$^2$ so that the coating weight, dry basis, was 10 g/m$^2$; the paper was then dried.

The coated paper was supercalendered to obtain an image-receiving sheet having a smoothness under said TAPPI Standard of 230 sec/10 ml and an air permeability under said ASTM of 100 sec/100 ml. The image-receiving sheet was subjected to heat transfer recording in the same way as in Example 1. An image transferred to the image-receiving sheet had good quality. The image was free from white dropouts, irregular density, mottling, etc. The fixing ability of the transferred image was good.

COMPARATIVE EXAMPLE 1

A coating composition was prepared in the same way as in Example 1 except that the amount of said natural ground calcium carbonate having a mean particle size of 2$\mu$ was 55 parts and the amount of said kaolin was 45 parts. The coating composition was applied by means of an air knife coater to one surface of an uncoated paper having a basis weight of 54 g/m$^2$ so that the coating weight, dry basis, was 10 g/m$^2$; the paper was then dried.

The coated paper was supercalendered to obtain an image-receiving sheet having a smoothness under said TAPPI Standard of 650 sec/10 ml and an air permeability under said ASTM of 600 sec/100 ml. The image-receiving sheet was subjected to heat transfer recording in the same way as in Example 1. An image transferred to the image-receiving sheet did not have good quality. The image was free from white dropouts, but it had irregular density and mottling. The fixing ability of the image was poor.

COMPARATIVE EXAMPLE 2

The coated paper prepared in Example 3 was supercalendered to obtain an image-receiving sheet having a smoothness under said TAPPI Standard of 150 sec/10 ml and an air permeability under said ASTM of 100 sec/100 ml. The image-receiving sheet was subjected to heat transfer recording in the same way as in Example 1. An image transferred to the image-receiving sheet did not have good quality. The image had many white dropouts while the fixing ability thereof was good.

Modification is possible in selecting the materials employed in preparing the present sheet as well as in the techniques employed without departing from the scope of the present invention.

What is claimed is:

1. An image-receiving sheet for a heat transfer recording system, adapted to receive an image transferred from a heat transfer recording sheet, comprising a substrate and an image-receiving layer of coating composition thereon, said coating composition comprising non-plate-shaped inorganic pigment as the principal pigment component and a binder, said binder being at least one of the substances selected from the group consisting of oxidized starch, etherified starch, esterified starch, cationic starch, carboxymethyl cellulose, methyl cellulose, hydroxyethyl cellulose, polyvinyl alcohols, sodium salt and ammonium salt of styrene-maleic anhydride copolymer, styrene-butadiene copolymer, vinyl acetate copolymer and vinyl chloride copolymer, the smoothness under TAPPI Standard T 479 om-81 of the image-receiving surface thereof being 200 to 1,000 sec/10 ml, and the air permeability under ASTM D726 Method B of said image-receiving sheet being below 500 sec/100 ml.

2. An image-receiving sheet as claimed in claim 1 wherein the air permeability thereof under ASTM D726 Method B is 30 to 500 sec/100 ml.

3. An image-receiving sheet as claimed in claim 1 wherein said pigment component of said coating composition comprising 60 to 100% by weight of non-plate-shaped inorganic pigment and 40 to 0% by weight of other pigments, said binder being present in an amount of 5 to 60% by weight of the total pigment component.

4. An image-receiving sheet as claimed in claim 1 wherein said non-plate-shaped inorganic pigment comprises any one or more in the form of fine particles selected from the group consisting of zeolite, precipitated calcium carbonate, natural ground calcium carbonate, silica, magnesium silicate, titanium dioxide and satin white.

5. Heat transfer recording sheets comprising a heat transfer recording sheet and an image-receiving sheet releasably laid on the ink layer side of said heat transfer recording sheet, said image-receiving sheet having a coating layer comprising non-plate-shaped inorganic pigment as the principal pigment and a binder, said binder being at least one of the substances selected from the group consisting of oxidized starch, etherified starch, esterified starch, cationic starch, carboxymethyl cellulose, methyl cellulose, hydroxyethyl cellulose, polyvinyl alcohols, sodium salt and ammonium salt of styrene-maleic anhydride copolymer, styrene-butadiene copolymer, vinyl acetate copolymer and vinyl chloride copolymer, and having a smoothness under TAPPI Standard T 479 om-81 of 200 to 1,000 sec/10 ml and an air permeability under ASTM D726 method B of below 500 sec/100 ml.

* * * * *